United States Patent [19]

Romano

[11] Patent Number: 4,696,243

[45] Date of Patent: Sep. 29, 1987

[54] PNEUMATIC ACTION ACCESSORY HOLDER SPECIFICALLY FOR SEWING MACHINES

[76] Inventor: Antonino Romano, Via Chiesa Nuova 22, 03039 Sora (FR), Italy

[21] Appl. No.: 871,403

[22] PCT Filed: Aug. 28, 1985

[86] PCT No.: PCT/IT85/00031

§ 371 Date: Apr. 29, 1986

§ 102(e) Date: Apr. 29, 1986

[87] PCT Pub. No.: WO86/01547

PCT Pub. Date: Mar. 13, 1986

[51] Int. Cl.[4] ..... D05B 23/00; D05B 75/00

[52] U.S. Cl. ..... 112/257; 112/130; 112/143; 112/152; 112/153; 112/270; 112/276; 112/301

[58] Field of Search ..... 112/115, 270, 276, 301, 112/141, 142, 143, 130, 129, 2, 153, 152

[56] References Cited

U.S. PATENT DOCUMENTS

| | | | |
|---|---|---|---|
| 3,592,153 | 7/1971 | Margereson | 112/276 |
| 3,736,892 | 6/1973 | Gray | 112/141 |
| 3,747,548 | 7/1973 | Brophy et al. | 112/301 X |
| 3,786,768 | 1/1974 | Kosrow et al. | 112/143 |
| 3,875,881 | 4/1975 | Marforio | 112/141 X |
| 4,055,127 | 10/1977 | Sharp | 112/143 |
| 4,202,286 | 5/1980 | Freire Costas | 112/301 X |

FOREIGN PATENT DOCUMENTS

| | | |
|---|---|---|
| 1485115 | 8/1969 | Fed. Rep. of Germany . |
| 914002 | 9/1946 | France . |
| 2396112 | 1/1979 | France . |

*Primary Examiner*—H. Hampton Hunter

*Attorney, Agent, or Firm*—Stevens, Davis, Miller & Mosher

[57] ABSTRACT

An accessory pneumatically operated holding device is disclosed, specifically for industrial sewing machines which device comprises a profiled blade accessory holding element which can be moved by a pneumatic piston along a backward and forward travel with extreme and adjustable precision.

The above device can be readily removed from the working plane of the sewing machine.

10 Claims, 8 Drawing Figures

PNEUMATIC ACTION ACCESSORY HOLDER SPECIFICALLY FOR SEWING MACHINES

The present invention relates to a pneumatically operated accessory carrying device for industrial sewing machines.

More particularly, this invention relates to a device comprising: a base which can be separated into three plates suitably arranged for adapting and anchoring the device on a working plane; a gaseous fluid distributor by which a double acting cylinder is fed and also supported; and means for controlling and adjusting the stroke of an accessory holder. The elements are assembled in various configurations to adapt this device to the different sewing machines of the industry.

As is known accessories, used for cloth bordering, hemming, guiding and the like, are mounted in a fixed positions on the sewing machines. Consequently, time is wasted each time there is a removal and replacement of an accessory from the working plane. Furthermore no device is known where in addition to handling, i.e. to moving the accessories back and forth with respect to the working position, as required for making garments on home sewing machines, it also is adaptable to industrial sewing machines.

An object of the present invention is to provide a device avoiding extensive handling and sustituting of accessories and accessory holding devices. A further object of the present invention is to provide a device adaptable with suitable adjustments to industrial sewing machines.

A specific object of the present invention is to provide a pneumatically actuated accessory holding device for industrial sewing machines wherein decomposable metal milled blade base means are provided in combination which present a first seat for an accessory holding slider, a second seat for adjustable limit means, a third seat for housing rapid release means, a fourth seat means for a distributor of gaseous fluid and means for fixing the device on a working plane; fluid regulating connector means being provided on said distributor along with at least two ways for feeding a fluid; a double acting cylinder means being provided which include an adjustable moving rod means connected with an adjustable transmission leg intended for actuating said accessory holder sliding means.

This invention will be better understood by the following description and the attached drawings in which a preferred embodiment thereof will be illustrated. In the drawings.

Figure 1:
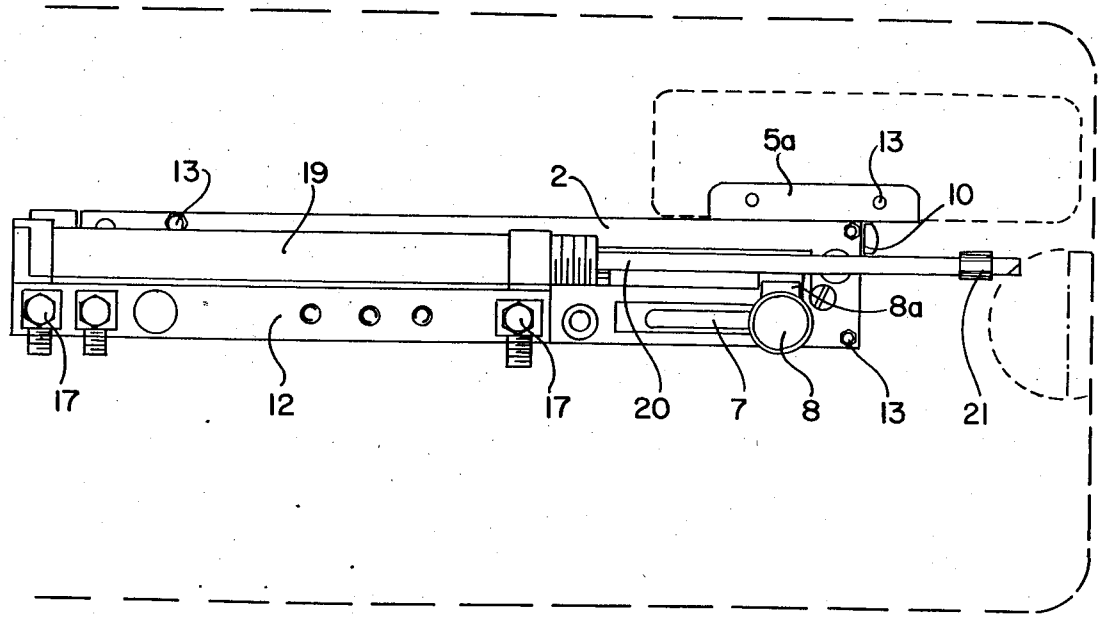
FIG. 1 shows a top plan view of the device according to the invention wherein the working plane of a sewing machine is indicated by a point and dash line while the accessory of the sewing machine is indicated by a dashed line.

According to a preferred embodiment thereof the device of this invention comprises a rigid base formed by three milled plates 1,2,3 which can be taken apart.

Between the lower plate 1 and the upper plate 2 a sliding assembly is included which is formed by a sliding blade *6a,6b* packet between which a blade 5 is included. A blade *5a* extends from blade 5 which extension is provided with at least two holes *5a'* on which the machine accessory is attached.

The blade packet, comprising blades *6a* and *6b* serve to adjust the height of the position of blade 5. Both the blade packet *6a,6b* and blade 5 are attached to an upper counter plate 24' and a lower counter plate 24" which run along a slot 4 of both plates 1 and 2.

Counterplate 24' engages a small block *8a* at the end of limit stop 8, which small block *8a* provides the seat for the eventual assembly of the slide differentiated stop means (not shown).

The small block *8a* is movable along a seat 7 in both plates 1 and 2. Seat 7 is provided with knurlings along the sides thereof on which the small teeth of small block *8a* mesh for a quick and reliable locking.

A series of seats 11 are provided on plates 1 and 2 for anchoring by means of screws a prismatic body 12 attachable to a source of compressed air and straps (not shown) which can be used in some instances for anchoring the device to industrial sewing machines. The shape of these straps or fixing means will suitably change according to the various circumstamces. For locking an end of these straps, suitable seats 23 are provided.

The base assembly of this device comprises also a third removable plate 3 which can be attached to plate 1 by means of screw 3'. Plate 3 is made for adapting the overall dimensions of the device with respect to the different sewing machines as shown in FIG. 7.

Figure 7:
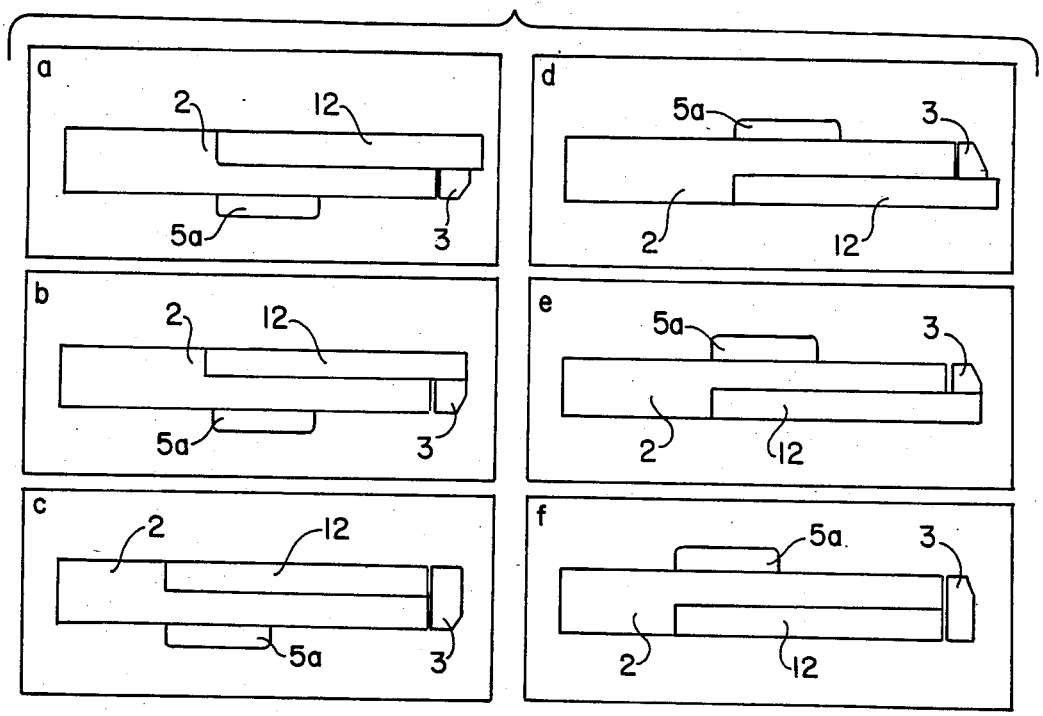
FIG. 7 shows some of the different working configurations of the device of this invention.
Figure 2:
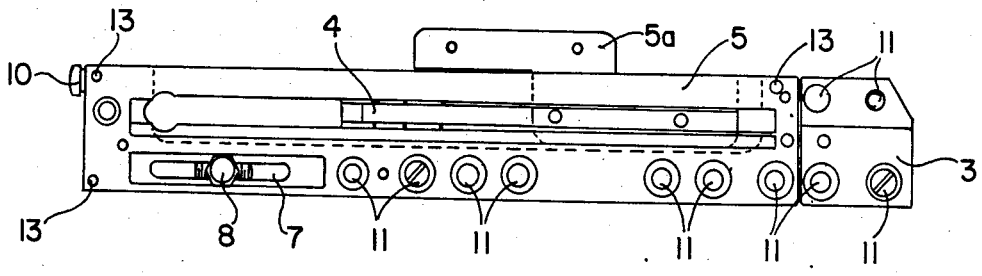
FIG. 2 shows a bottom plan view of a portion of the device of FIG. 1 rotated 180°.
Figure 3:
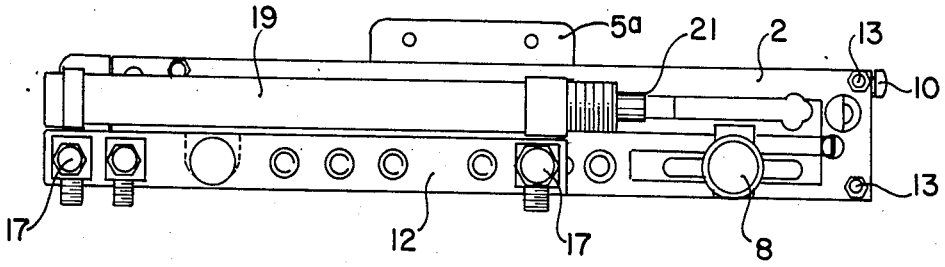
FIG. 3 shows a top plan view of the device of this invention where the double acting cylinder rod is shown in retracted position.
Figure 4:
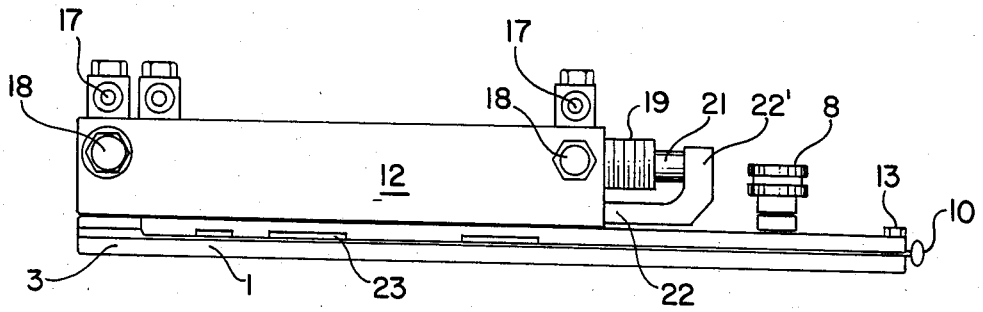
FIG. 4 shows a front elevational view of the above device with the pneumatic operating fluid distributor.
Figure 5:
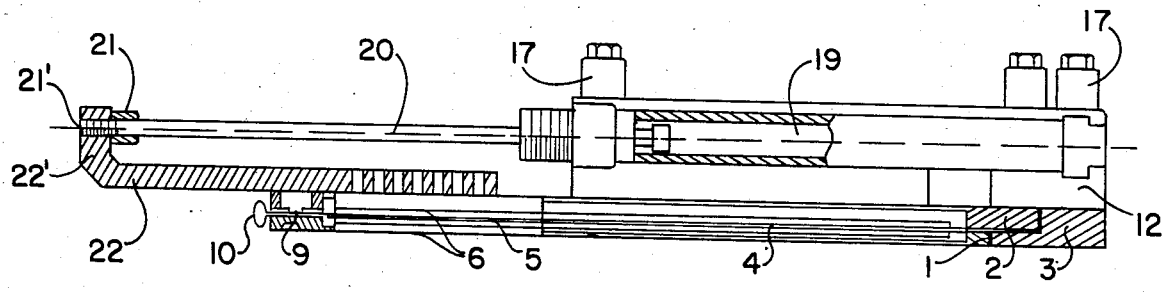
FIG. 5 shows a side back elevational partially cross sectioned view of FIG. 4 with the cylinder rod extended.

Actually the particular plate 3 permits the displacement of distributor 12 from configuration a to configuration f of FIG. 7 that is the positions suitable for adapting the present device to the different industrial sewing machines.

On the base means three seats for threaded and lockable feet 13 are provided for adjusting the device of the invention in height on the working plane.

Figure 6:
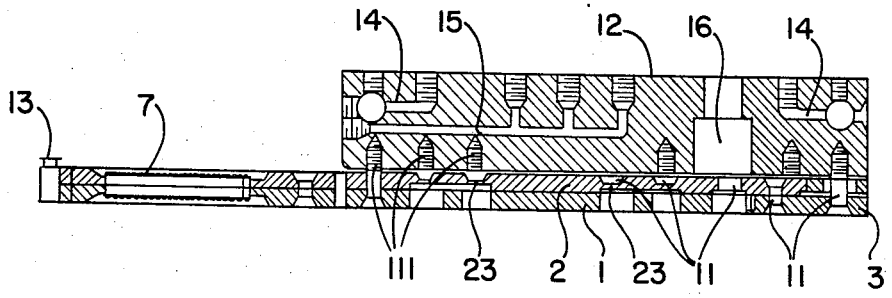
FIG. 6 shows a partially cross sectioned view of the distributor.
Figure 8:
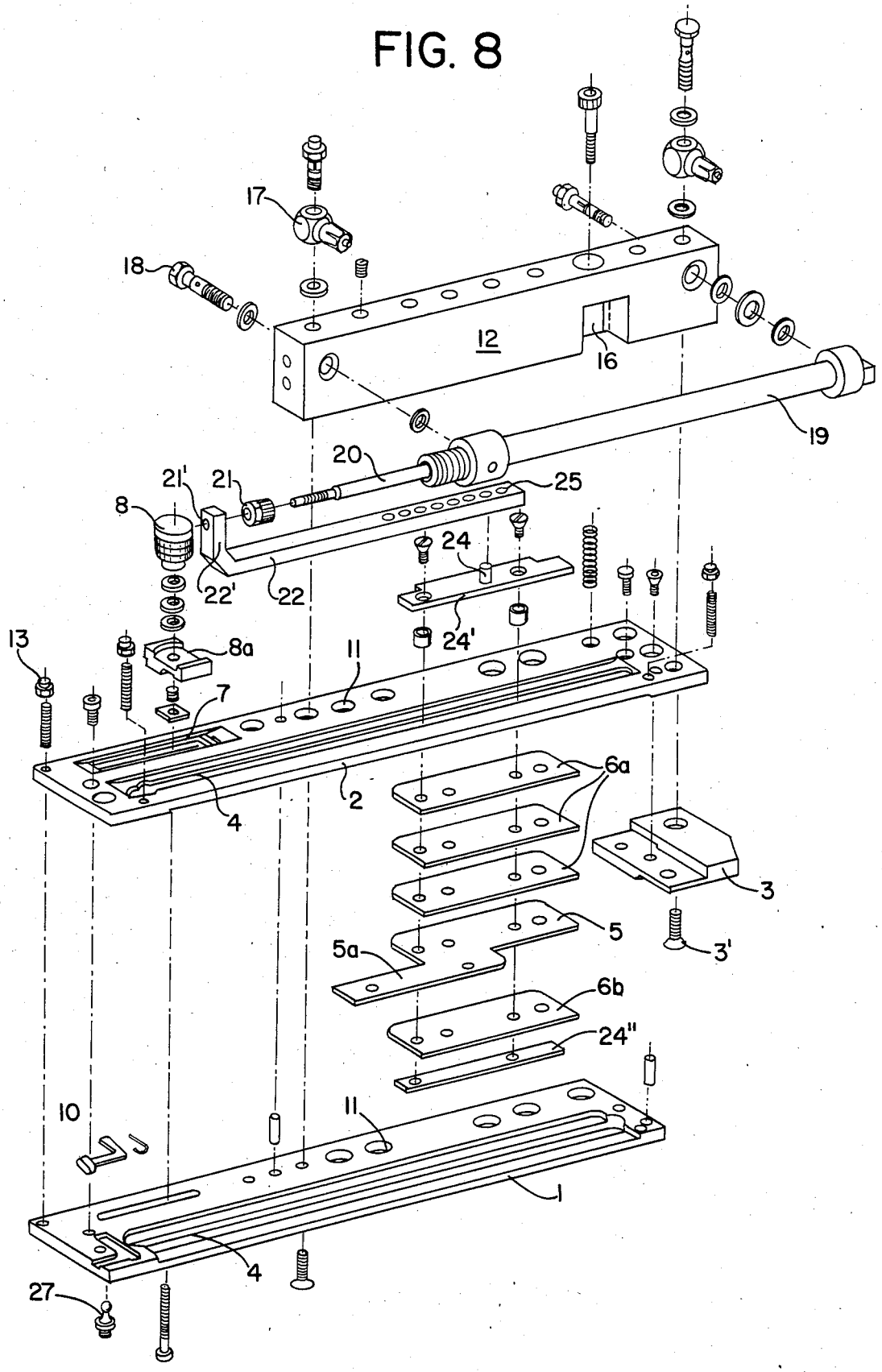
FIG. 8 shows an exploded view of the device of this invention.

Fluid feeding distributor 12 (FIG. 6) comprises primary feed ways 14, a secondary feed way 15, seats 11 for clamping screws, a seat 16 for a screw by which rotation of the device is performed. Flow adjusting connectors 17 are set in a normal position. Flow adjusting connectors 18 are set in a supplementary position in which they function also as a support for double acting cylinder 19. Cylinder 19 actuates a threaded rod 20 connected with an adjustable leg 22 which transmits its translation movement to the accessory holder 5.

According to the preferred embodiment illustrated in the drawings, the present invention intends to provide the solutions for permitting:

(a) good handleability of accessories which are usually employed in industrial sewing machines;

(b) device mobility according to the invention without any need for totally dismounting; and (c) adaptability of the device to industrial sewing machines.

The handleability of the accessories fastened to the slider is imparted to double acting cylinder 19 which when suitably controlled by fluid distributor 12 can slide slider 5 into the working position (next to the needle) or into a rest position (position of the cylinder rod retracted).

One benefit of the device of this invention results from not encumbering the working plane whenever the accessory is not being used. This benefit results from a quick release 10 by a back anchoring screw (not shown in the drawings) about which the device rotates. The screw can be housed, for instance, in seat 16 provided for in distributor 12. In fact, the locking of this device to the sewing machine working plane is made by means of two pins secured onto the machine working plane, of which pin 27 has a round horizontal groove on which a locking and release system 10 engages. The system 10 is formed by a spring biassed knife which engages the groove and which is released by depressing button 10 allowing the device rotation with respect to the machine working plane without any need, for totally dismantling it whenever it is to be removed from its working position.

The adaptability of the object of this invention to the sewing machines presently being used is ensured by the particular configuration of the base components which are so formed that any lengthenings, shortenings and symmetrical overturnings of the device components are feasible (see FIG. 7) whereby beyond everything else millimetric adjustments are allowed.

As already mentioned, the blade packet comprising blades 6*a* and 6*b* and blade 5 are attached to an upper counter plate 24' and a lower counter plate 24''.

Counter plate 24' has a pin 24 which fits into one of a plurality of holes 25 which are distributed at constant distances along leg 22 with the purpose of compensating for any possible change of the distributor 12 position with respect to the device base in the different obtainable positions in such way that the stroke of the rod 20 of the cylinder 19 is the amplest possible.

Leg 22 is bent upwards to form an arm 22' of which the upper end has a hole 21' aligned with a rod 20 of the pneumatic double acting cylinder or jack 19 which is fastened onto the prismatic body 12 of a compressed air distributor which extends parallel to cylinder 19.

A further finer adjustment can be obtained as follows:

Into hole 21' extends the threaded end of cylinder rod 20 while a threaded locking ring 21 is inserted for adjusting the distance between leg 22' and cylinder 19.

Therefore the threaded locking ring 21 allows for a finer adjustment of the cylinder rod strok than does the pitch of holes 25.

It has to be further noted that distributor 12 fixed in different positions parallel to the cylinder stroke permits optimally adapting the accessory mounted on the accessory holder profiled plate 5*a* with respect to the needle on the different sewing machines to which the device is assembled.

The present invention has been described with specific reference to an embodiment thereof but it is to be understood that variations and modifications can be added by those skilled in the art without escaping from the related scope of protection by the present industrial patent.

What is claimed is:

1. A pneumatic action accessory holding device comprising first and second base plates, each base plate defining an elongated slot; a blade defining an accessory holder profiled plate positioned between said first and second plates and movable parallel to said slots; a distributor; means to mount said distributor on said first and second plates in different positions; a pneumatic cylinder mounted on said distributor to which fluid is fed from said distributor; a piston rod mounted within said pneumatic cylinder and having an end extending therefrom; a leg having an end connected to said extended end of said piston rod and said blade; means for limiting the movement of the blade mounted on said first and second plates; and seats on said first and second plates for fixing said device to a sewing machine.

2. The pneumatic action accessory holding device according to claim 1 including a third base plate, said third base plate being removably attached to said first and second base plates to determine the length of the device.

3. The pneumatic action accessory holding device according to claim 2 wherein said means to mount said distributor are disposed on said first, second and third base plates.

4. The pneumatic action accessory holding device according to claim 1 wherein said leg defines a series of holes therealong and a threaded hole in the end of said leg, said piston rod having a threaded end, said threaded end being screwed into the threaded hole in the end of said leg and including a locking ring mounted on said piston rod and a pin for mounting in one of said series of holes in said leg to allow position changes of the distributor with respect to the first and second base plates.

5. The pneumatic action accessory holding device according to claim 1 wherein said distributor defines three independent distributing channels, two of which govern the forward and backward travel of the piston rod, the third channel controlling the fluid in the two channels.

6. The penumatic action accessory holding device according to claim 1 wherein said means to mount said distributor are positioned relative to each other to permit the device to be set in such configuration that said device can operate in specular symmetry parallel to the needle.

7. The pneumatic action accessory holder according to claim 1, including means to anchor the device to a work table comprising a first pin acting as a hinge axis about which the device can pivot, a second pin having a circumferential groove and a pivotal hook which engages and releases from the groove of said second pin to permit device rotation with respect to the working position.

8. The pneumatic action accessory holder according to claim 1 including at least two means to feed fluid to said distributor and at least two means to control flow of fluid which also support the pneumatic cylinder on said distributor.

9. The pneumatic action accessory holding device of claim 1 including height adjusting feet for said first and second plates to change the position of the device with respect to the working plane and blades for insertion between said first and second plates.

10. The pneumatic action accessory holding device of claim 1 wherein said first and second plates define complementary knurled slots and the means for limiting the movement of the blade comprises a block fitting within said knurled slots and means to prevent said block from being slidable along said knurled slots.

* * * * *